US006481242B2

(12) United States Patent
Shirakata et al.

(10) Patent No.: US 6,481,242 B2
(45) Date of Patent: Nov. 19, 2002

(54) CONDENSER AND FREEZER

(75) Inventors: Yoshinori Shirakata, Takasago (JP); Kenji Ueda, Takasago (JP); Wataru Seki, Takasago (JP); Yoichiro Iritani, Takasago (JP); Akihiro Kawada, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/874,059

(22) Filed: Jun. 6, 2001

(65) Prior Publication Data

US 2001/0049944 A1 Dec. 13, 2001

(30) Foreign Application Priority Data

Jun. 7, 2000 (JP) ..... 2000-170896

(51) Int. Cl.[7] ..... F25B 39/04
(52) U.S. Cl. ..... 62/506; 165/110; 165/159
(58) Field of Search ..... 62/506; 165/110, 165/113, 159, 160

(56) References Cited

U.S. PATENT DOCUMENTS

| | | | | |
|---|---|---|---|---|
| 2,324,627 A | | 7/1943 | Jones | |
| 2,830,797 A | * | 4/1958 | Garland | 165/110 |
| 3,096,630 A | * | 7/1963 | Weller | 62/506 |
| 3,118,290 A | * | 1/1964 | Weller | 62/506 |
| 3,791,102 A | * | 2/1974 | Huntington | 065/104.25 |
| 3,859,820 A | * | 1/1975 | Dobney | 62/506 |
| 3,963,071 A | * | 6/1976 | Levin et al. | 165/104.19 |
| 4,078,399 A | * | 3/1978 | Sugimoto et al. | 62/476 |
| 4,136,736 A | * | 1/1979 | Small | 122/510 |
| 4,828,021 A | * | 5/1989 | Small | 122/510 |
| 4,972,903 A | * | 11/1990 | Kwok | 165/158 |

FOREIGN PATENT DOCUMENTS

| | | |
|---|---|---|
| EP | 0 844 453 | 5/1998 |
| EP | 0 962 734 | 12/1999 |
| JP | 08-145502 | 6/1996 |

* cited by examiner

*Primary Examiner*—Denise L. Esquivel
*Assistant Examiner*—Mohammad M. Ali
(74) *Attorney, Agent, or Firm*—Oblon, Spivak, McClelland, Maier & Neustadt, P.C.

(57) ABSTRACT

A condenser for condensing and liquifying a refrigerant by inducing the refrigerant into a receptacle (14), in which cooling water is fed through a plurality of thermal transmission pipes (15) which are arranged in bundles. A plate body (20) is provided between the bundles of the thermal transmission pipes, and slopes diagonally downwardly when viewed in cross-section from the direction of the length of the thermal transmission pipes. Consequently, the refrigerant falling toward the thermal transmission pipes at low positions is led diagonally downwardly by the plate body, so that the liquid film of refrigerant which adheres to the surfaces of the thertmal transmission pipes does not become too thick, thereby preventing reduction in the thermal transmittancy of the thermal transmission pipes.

13 Claims, 4 Drawing Sheets

CONDENSER AND FREEZER

BACKGROUND OF THE INVENTION

1. Field of the Invention

The present invention relates to a condenser which performs heat exchange between cooling water and a refrigerant, condensing and liquifying the refrigerant, and to a freezer comprising the condenser.

2. Description of the Related Art

In a large-scale structure such as a building, cooling water, which has been cooled in a freezer, is fed back through the structure along interconnecting pipes provided therein, and rooms are cooled by heat exchange of the cooling water with the air in the rooms.

FIG. 6 shows one example of a cooler which is installed in a freezer. The cooler has a plurality of heating pipes 2, alternatively provided and bundled, for feeding cooling water into a cylindrical receptacle 1, which a refrigerant is led into.

The thermal transmission pipes 2 are separated into inlet side pipes which connect to a cooling water entrance 3, and outlet side pipes which connect to a cooling water exit 4. A refrigerant entrance 5, which the refrigerant is led into, is provided in the upper section of the receptacle 1, and a refrigerant exit 6, which the refrigerant is led out from, is provided in the lower section of the receptacle 1.

The cooling water, which has flowed through the cooling water entrance 3, passes through the receptacle 1, turns in a water chamber (not shown), passes again through the receptacle 1 and is fed out from the cooling water exit 4. In this process, a hightemperature high-pressure gas refrigerant, which is led to the receptacle 1 from a compressor (not shown), is condensed and liquified by heat exchange with the cooling water. The cooling water takes the heat from the refrigerant, increases in temperature and is led out from the receptacle 1.

The evaporator of the structure as described above has problems such as the following. Although the refrigerant which is led into the receptacle 1 is condensed and liquified by heat exchange with the cooling water on the surfaces of the thermal transmission pipes 2, the refrigerant, which has been condensed and liquified in this way on the surfaces of the thermal transmission pipes 2 which are provided at comparatively high positions, falls in its liquified state toward the thermal transmission pipes 2 provided at lower positions, whereby much of the liquified refrigerant tends to adhere to the lower thermal transmission pipes 2, producing a thick liquid film.

Consequently, the thermal transmittancy of the lower thermal transmission pipes 2 decreases, making it difficult to perform heat exchange with a gas refrigerant which has not yet been condensed. As a result, the capability of the condenser is inadequate.

SUMMARY OF THE INVENTION

The present invention has been realized in consideration of the problems as described above, and aims to increase the thermal transmittancy in the condenser, and thereby provide a freezer having high cooling efficiency.

A condenser and a freezer having the following constitutions are used in order to achieve the above objects. A first aspect of the present invention provides a condenser for condensing and liquifying a refrigerant by inducing the refrigerant into a receptacle, in which cooling water is fed to through a plurality of thermal transmission pipes which are arranged in bundles. A plate body is provided between the bundles of the thermal transmission pipes, and slopes diagonally downward when viewed in cross-section from the direction of the length of the thermal transmission pipes.

In this condenser, the refrigerant which falls toward thermal transmission pipes provided at low positions is fed diagonally downward by the plate body, preventing the liquid film of the refrigerant which adheres to the surfaces of the thermal transmission pipes provided at low positions from becoming too thick. As a consequence, it is possible to prevent reduction in the thermal transmittancy of the thermal transmission pipes.

Further, the flow of the vaporized refrigerant is repelled by the plate body, driving it upwards against the thermal transmission pipes which are adjacently located above the plate body, thereby helping to remove the liquid film. This makes it possible to prevent reduction in the thermal transmittancy of the thermal transmission pipes.

According to a second aspect of the present invention, in the condenser of the first aspect, a plurality of the plate bodies are provided at the upper and lower sides with gaps therebetween.

In this condenser, the function of each of the plate bodies is the same as in the first aspect, but in a large-scale condenser having an extremely large number of thermal transmission pipes, the refrigerant can be exhausted effectively from the groups of pipes by providing the plurality of plate bodies between the thermal transmission pipes.

According to a third aspect of the present invention, in the condenser of the first aspect, a plurality of plate bodies sloping in different angles and directions are combined, and form a chevron-shape which projects upwardly when viewed in cross-section from the direction of the length of the thermal transmission pipes.

In the case of the large-scale condenser as described above, when the plate bodies are sloping in one direction, the refrigerant accumulates in one place inside the receptacle, whereby the drainage of the refrigerant from the receptacle does not progress smoothly. Accordingly, in this condenser, the refrigerant falling toward the thermal transmission pipes provided at low positions is caught and fed in two different directions. Consequently, the refrigerant does not accumulate in one place and there is no deterioration in the drainage of the refrigerant from the receptacle. Incidentally, the chevron-shaped plate bodies may be comprised by joining two plate bodies together, or by using a plate body which is already chevron-shaped.

According to a fourth aspect of the present invention, in the condenser of the third aspect, a plurality of the plate bodies forming the chevron-shape are provided with gaps therebetween.

In this condenser, the function of each of the individual plate bodies is the same as in the third aspect, but in a large-scale condenser having an extremely large number of thermal transmission pipes, the refrigerant can be exhausted effectively from the groups of pipes by providing the plurality of chevron-shaped plate bodies between the thermal transmission pipes.

According to a fifth aspect of the present invention, in the aforementioned condenser, the angle of the plate body (bodies) with the horizontal is set between 0 degrees and 60 degrees, and is preferably set between 3 degrees and 10 degrees.

When the angle of the plate bodies with the horizontal is too steep, the refrigerant falling to the lower thermal transmission pipes increases as in conventional condensers; when the angle is too gentle, the flow of the refrigerant becomes poor, making it difficult to exhaust the refrigerant from the groups of pipes. In this condenser, the angle is set between 0 degrees and 60 degrees, and is preferably set between 3 degrees and 10 degrees, making it possible to stop the liquified refrigerant falling toward the thermal transmission pipes which are provided at comparatively low positions, while enabling the refrigerant to be exhausted effectively from the groups of pipes.

A freezer according to a sixth aspect of this invention comprises the condenser of the present invention as described above, an expansion valve which decompresses a liquified refrigerant, an evaporator which evaporates and vaporizes the decompressed refrigerant, and a compressor which compresses the vaporized refrigerant and supplies it to the condenser.

In this freezer, the thermal transmittancy of the thermal transmission pipes in the condenser is increased as described above, resulting in an increased heat exchange rate. Therefore, the same capability as a conventional condenser can be achieved even when energy consumption is reduced.

DESCRIPTION OF THE PREFERRED EMBODIMENTS

A condenser and a freezer according to a first embodiment of the present invention will be explained with reference FIGS. 1 to 3.

Figure 1:
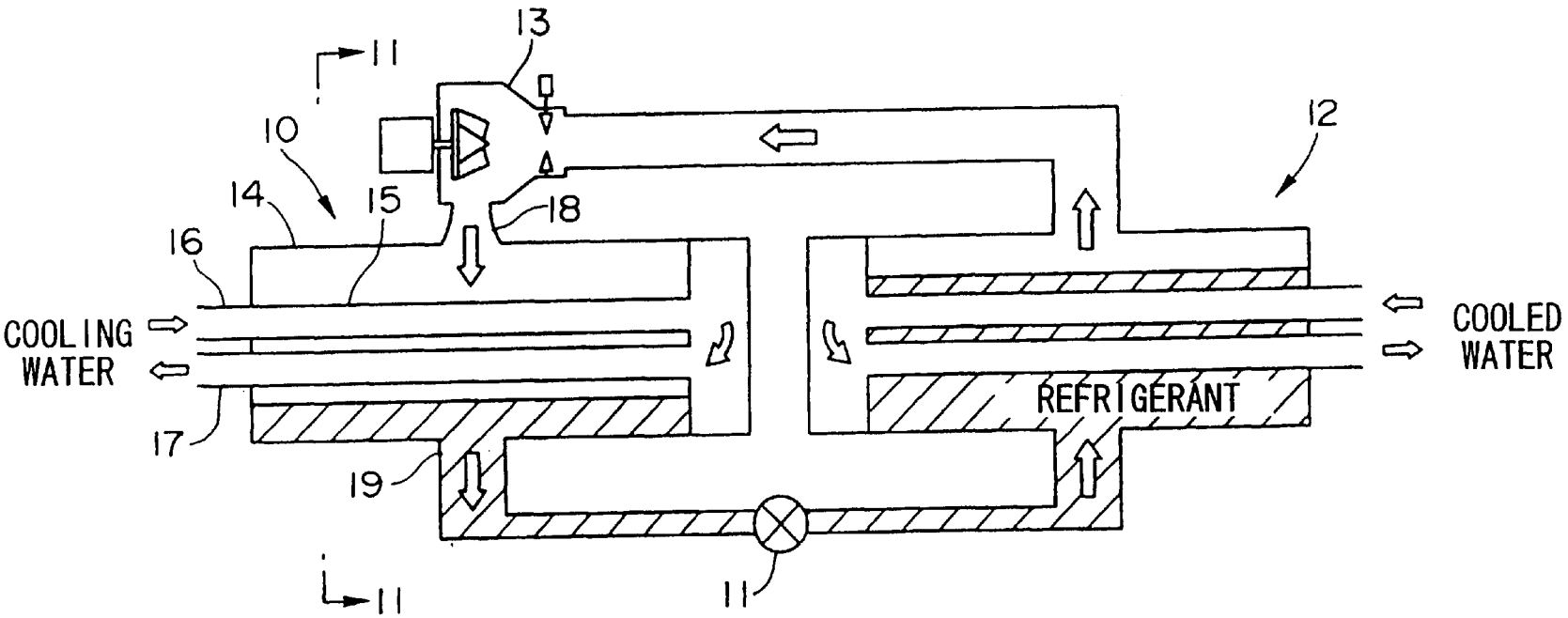
FIG. 1 is a schematic structural diagram of a freezer according to a first embodiment of this invention.

FIG. 1 is a schematic diagram showing the constitution of a freezer. The freezer shown in FIG. 1 comprises a condenser 10 which condenses and liquifies a refrigerant by performing heat exchange between cooling water and a vaporous refrigerant, an expansion valve 11 which decompresses the condensed refrigerant, an evaporator 12 which cools the cooling water by performing heat exchange between the condensed refrigerant and the cooling water, and also evaporates and vaporizes the refrigerant, and a compressor 13 which compresses the vaporized refrigerant and supplies it to the condenser. The freezer manufactures cooling water in the evaporator 12, and is used in air conditioning and the like of buildings.

The condenser 10 comprises a great number of thermal transmission pipes 15 which feed cooling water into a cylindrical receptacle 14 which the refrigerant is induced into. The thermal transmission pipes 15 are arranged in a bundle (simplified in the illustration in FIG. 1) and provided parallel to the length of the receptacle 14. The thermal transmission pipes 15 are separated into pipes which connect to a cooling water entrance 16 and pipes which connect to a cooling water exit 17, the direction of the flow of the cooling water being different in each of these two types of pipe. A refrigerant entrance 18, which the refrigerant is led into, is provided in the upper section of the receptacle 14, and a refrigerant exit 19, which the refrigerant is led out from, is provided in the lower section of the receptacle 14.

Figure 2:
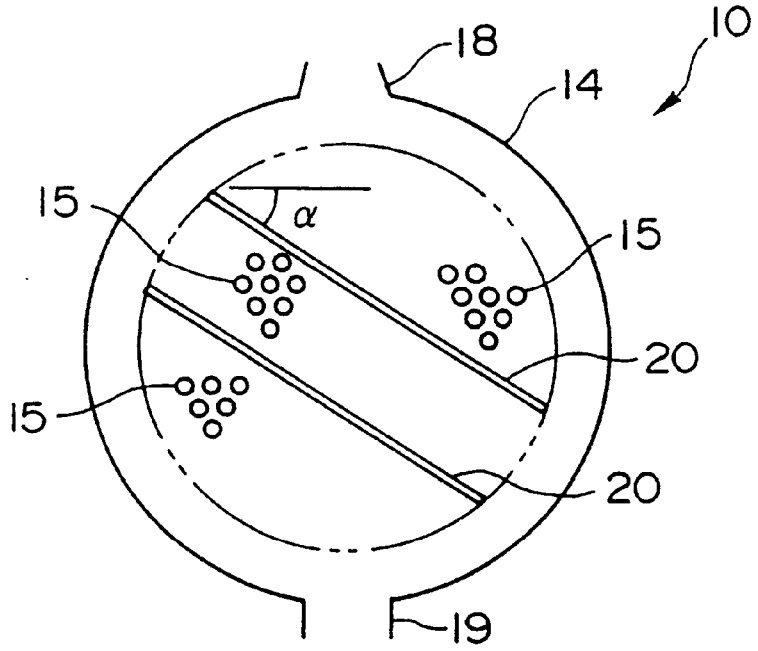
FIG. 2 is a cross-sectional view of a condenser taken along the line II—II in FIG. 1.
Figure 3:
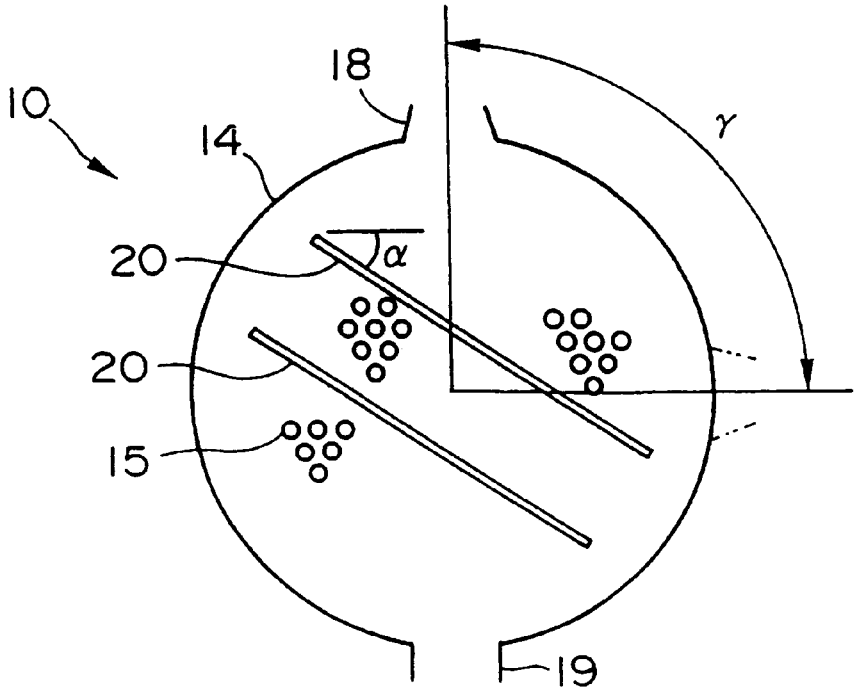
FIG. 3 is a diagram illustrating the relationship between the arrangements of a refrigerant entrance and a plate body.

FIG. 2 is a cross-sectional view of the condenser 10 as seen from the direction of the length of the thermal transmission pipes 15. All the thermal transmission pipes 15 have equal diameters, and are arranged in an alternative formation with equal gaps therebetween. Plate bodies 20 and 20 slope diagonally downwards and are provided substantially parallel to each other with a gap therebetween so as to cut across the groups of bundled thermal transmission pipes 15 near the center. The angles $\alpha$ between these plate bodies 20 and the horizontal are set between 0 degrees and 60 degrees (preferably set between 3 degrees and 10 degrees).

The plate bodies 20 are divided between parting strips (not illustrated in FIG. 2, these are provided so as to parallel to the surface of the paper) which hold the thermal transmission pipes 15 in the receptacle 14, but the divided plate bodies 20 are treated as a single plate which covers the entire length of the thermal transmission pipes 15 and has approximately the same length as the thermal transmission pipes 15. Furthermore, the widths of the plate bodies 20 are set so that both their edges reach the outermost perimeters of the groups of pipes 15.

In the condenser 10 having the constitution as described above, the compressed gas refrigerant is led from the refrigerant entrance 18 into the receptacle 14 and is condensed and liquified as it passes between the groups of thermal transmission pipes 15 arranged in an alternative formation; the refrigerant gathers at the lower portion of the receptacle 14 and is led through the refrigerant exit 19 to the outside.

The thermal transmission pipes 15 at comparatively high positions are exposed directly to the gas refrigerant, which is condensed and liquified on the surfaces of these thermal transmission pipes 15 by heat exchange with the cooling water. The liquified refrigerant drops downward toward the thermal transmission pipes 15 at comparatively low positions, but is led diagonally downward by the upper plate body 20 and exhausted to the outside of the group of pipes 15.

The gas refrigerant is supplied between the plate bodies 20 and 20 and further below the lower plate body 20, depend on the rise of the static pressure in the receptacle 14. Between the plate bodies 20 and 20, the liquified refrigerant is led diagonally downward by the lower plate body 20 and exhausted to the outside of the group of pipes 15. Further below the lower plate body 20, the liquified refrigerant falls freely away from the group of pipes 15.

Due to the above-mentioned function of the plate bodies 20 inside the condenser 10, the liquid film of refrigerant which adheres to the surfaces of the thermal transmission pipes 15 does not become too thick. This makes it possible to prevent reduction in the thermal transmittancy of the thermal transmission pipes 15, especially those which are positioned at the lower side of the group of pipes 15. As a consequence, the capability of the condenser itself can be increased.

Furthermore, the flow of the vaporized refrigerant inside the condenser 10 is repelled by the plate bodies 20, driving it upwards against the thermal transmission pipes 15 which are adjacently located above the plate bodies 20 and thereby removing the liquid film. This makes it possible to prevent reduction in the thermal transmittancy of the thermal transmission pipes 15, thereby increasing the capability of the condenser itself.

Moreover, since the angle aL is set between 0 degrees and 60 degrees, it is possible to stop the liquified refrigerant from falling toward the thermal transmission pipes 15 which are provided at comparatively low positions while efficiently exhausting the refrigerant from the group of pipes 15.

The cooling efficiency of the freezer can be increased by applying the above structure in the condenser 10, increasing the thermal transmittancy.

The present embodiment comprises two plate bodies 20, upper and lower, but one, three, or more may be provided in accordance with the size of the freezer and its required capability. Furthermore, in the present embodiment, the plate bodies 20 are treated as a single plate in the length direction, but the height of the plate bodies 20 may be altered the height thereof in each part which is segregated by the parting strips so that the plate bodies 20 appear stagger when viewed from the side. In addition, holes for allowing the gas refrigerant to flow downward may be provided in the plate bodies 20.

Of course, dimple tubes, fin tubes, and various other types of tube may be used as the thermal transmission pipes 15.

In this embodiment, the refrigerant entrance 18 is provided just above the receptacle 14, but the position of the refrigerant entrance 18 is not limited to this and may sometimes be provided diagonal to the receptacle 14 or running directly horizontal therefrom. That is, as shown in FIG. 3, the angle $\gamma$ of the refrigerant entrance 18 with the horizontal is set as appropriate between 0 degrees and 90 degrees.

Accordingly, when the refrigerant entrance 18 is provided diagonal to the receptacle 14 or running directly horizontal therefrom, the angle $\alpha$ of the plate bodies 20 is set with due consideration given to the induction angle (i.e. angle $\gamma$) of the refrigerant. However, it should be noted that, whatever the value of the angle $\gamma$, the slope direction of the plate bodies 20 is always such that the refrigerant is not induced toward the lower faces of the plate bodies 20.

A second embodiment of the evaporator and freezer of the present invention will be explained with reference to FIGS. 4 and 5. Here, identical reference numbers are appended to the members already described in the first embodiment, and these are not explained further.

Figure 4:
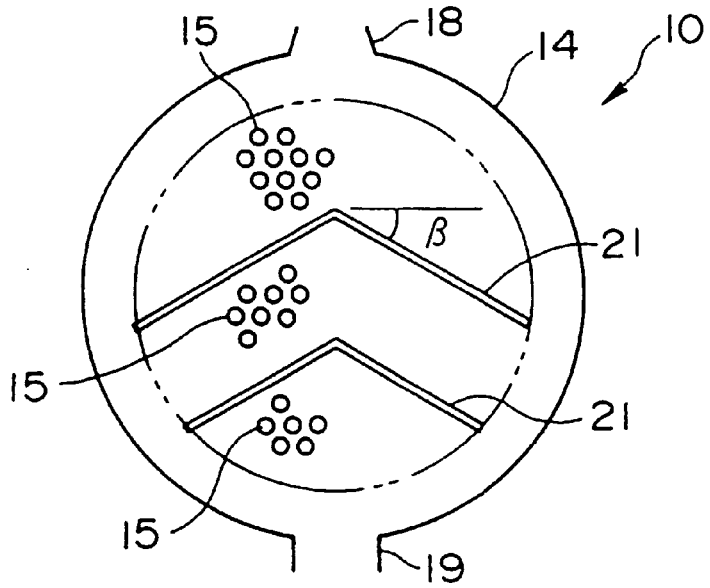
FIG. 4 is a cross-sectional view of a condenser according to a second embodiment of the present invention.

FIG. 4 is a cross-sectional view of the condenser 10 as viewed from the direction of the length of the thermal transmission pipes 15. Similar to the first embodiment, all the thermal transmission pipes 15 have equal diameters, and are arranged in alternative formation with equal gaps therebetween.

In this embodiment, plate bodies 21 which form a chevron-shape which projects upwardly when viewed in cross-section from the direction of the length of the thermal transmission pipes 15 are provided between the bundles of thermal transmission pipes 15 with spaces above and below, and extend around the near-center of the group of thermal transmission pipes 15. Furthermore, the angles $\beta$ between the oblique sides of the plate bodies 21 and the horizontal are each set between 0 degrees and 60 degrees.

Similar to the first embodiment, the plate bodies 21 are divided between parting strips, and are treated as a single plate which covers the entire length of the thermal transmission pipes 15 and has approximately the same length as the thermal transmission pipes 15. Furthermore, the widths of the plate bodies 21 are set so that the bottom edges of their oblique sides reach the outermost perimeters of the groups of pipes 15.

In the condenser 10 having the constitution as described above, the refrigerant is led from the refrigerant entrance 18 into the receptacle 14 and is condensed and liquified by heat exchange with the cooling water on the surfaces of the thermal transmission pipes 15 which are provided at comparatively high positions. The liquified refrigerant falls toward the thermal transmission pipes 15 which are provided at comparatively low positions, but is caught by the upper plate body 21 and fed in two different directions, and exhausted outside the group of pipes 15.

The gas refrigerant is supplied between the plate bodies 21 and 21, and further below the lower plate body 21, depend on the rise of static pressure in the receptacle 14. In this case, between the plate bodies 21 and 21, the liquified refrigerant is led in two different directions by the lower plate body 21 and is exhausted outside the group of pipes 15, and further below the lower plate body 21, the liquified refrigerant falls freely and away from the group of pipes 15.

Due to the above-mentioned function of the plate bodies 21 inside the condenser 10, the liquid film of refrigerant which adheres to the surfaces of the thermal transmission pipes 15 does not become too thick. Since the refrigerant does not accumulate in one place inside the receptacle 14, there is no deterioration in the drainage of the refrigerant from the receptacle 14. Moreover, the vaporized refrigerant is driven upwards against the thermal transmission pipes 15 which are adjacently located above the plate bodies 21, thereby helping to remove the liquid film. This makes it possible to prevent reduction in the thermal transmittancy of the thermal transmission pipes 15, especially those which are positioned at the lower side of the group of pipes 15.

Moreover, since the angles $\beta$ are set between 0 degrees and 60 degrees, it is possible to stop the liquified refrigerant from falling toward the thermal transmission pipes 15 which are provided at comparatively low positions while efficiently exhausting the refrigerant from the group of pipes 15.

In addition, the cooling efficiency of the freezer can be increased by applying the above structure in the condenser 10, increasing the thermal transmittancy.

The present embodiment comprises two plate bodies 21, upper and lower, but one, three, or more may be provided in accordance with the size of the freezer and its required capability. Furthermore, in the present embodiment, the plate bodies 21 are treated as a single plate in the length direction, but the height of the plate bodies 21 may be altered the height thereof in each part which is segregated by the parting strips so that the plate bodies 21 appear stagger when viewed from the side. In addition, holes for allowing the gas refrigerant to flow downward may be provided in the plate bodies 21.

Each of the plate bodies 21 may be comprised by joining two plate bodies together, or by using a plate body which is already chevron-shaped.

Figure 5:
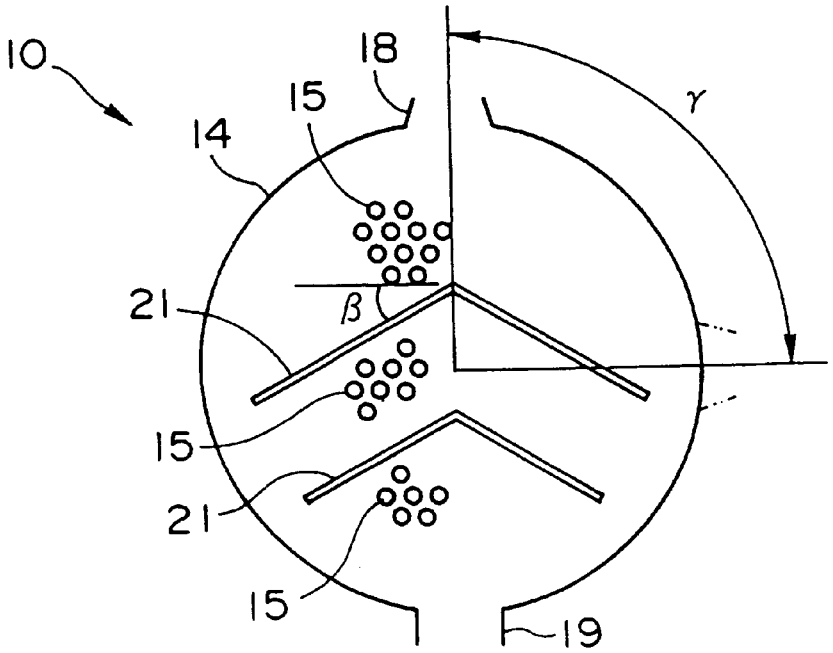
FIG. 5 is a diagram illustrating the relationship between the arrangements of a refrigerant entrance and a plate body.
Figure 6:
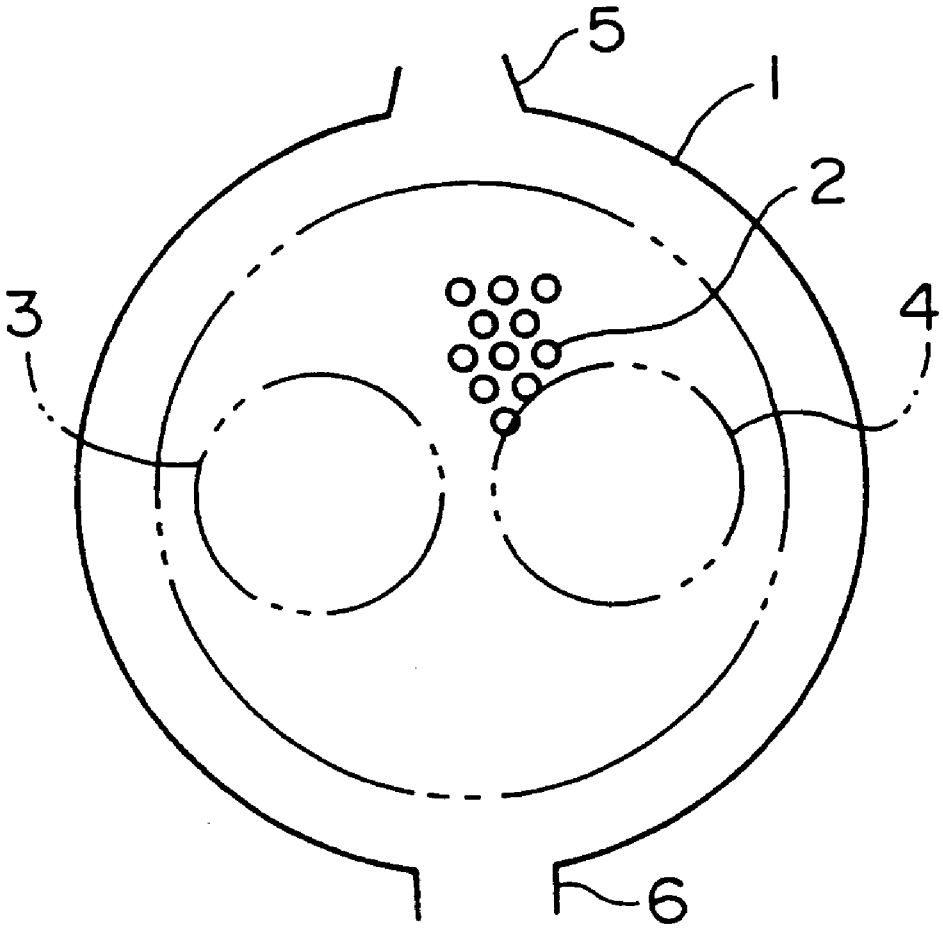
RELATED ART FIG. 6
FIG. 6 is a cross-sectional view of a conventional condenser installed in a freezer.

In this embodiment, the refrigerant entrance 18 is provided just above the receptacle 14, but, as shown in FIG. 5, since the angle $\gamma$ of the refrigerant entrance 18 with the horizontal is set as appropriate between 0 degrees and 90 degrees, when the refrigerant entrance 18 is provided diagonal to the receptacle 14 or running directly horizontal therefrom, the angles $\alpha$ of the plate bodies 21 are set in consideration of the induction angle (i.e. angle $\gamma$) of the refrigerant.

What is claimed is:

1. A condenser for condensing and liquefying a refrigerant, the condenser comprising:

a receptacle into which the refrigerant is induced;

thermal transmission pipes for carrying cooling water through the receptacle of the condenser, the thermal transmission pipes being arranged in at least first, second, and third bundles in the receptacle; and at least first and second plate bodies with the first plate body being located between the first and second bundles of the thermal transmission pipes, and the second plate body being located between the second and third bundles of the thermal transmission pipes, each of the first and second plate bodies sloping diagonally downwardly when viewed in crosssection from a direction of the length of the thermal transmission pipes.

2. The condenser according to claim 1, wherein the first and second plate bodies are spaced a same predetermined distance apart from each other at both upper and lower sides thereof.

3. A condenser for condensing and liquefying a refrigerant, the condenser comprising:

a receptacle into which the refrigerant is induced;

thermal transmission pipes for carrying cooling water through the receptacle of the condenser, the thermal transmission pipes being arranged in at least first, second, and third bundles in the receptacle; and at least first and second plate bodies with the first plate body being located between the first and second bundles of the thermal transmission pipes, and the second plate body being located between the second and third bundles of the thermal transmission pipes, each of the first and second plate bodies having first and second portions which slope diagonally downwardly in different directions from each other and are connected to each other at a predetermined angle to form a chevron-shape when viewed in cross-section from a direction of the length of the thermal transmission pipes.

4. The condenser according to claim 3, wherein the first portions of each of the first and second plate bodies are spaced a same predetermined distance apart from each other along an entire length of the first portions and the second portions of each of the first and second plate bodies are spaced the same predetermined distance apart from each other along an entire length of the second portion.

5. The condenser according to claim 1, wherein an angle between each of the first and second plate bodies and the horizontal is set in a range of from 0 degrees to 60 degrees.

6. The condenser according to claim 2, wherein an angle between each of the first and second plate bodies and the horizontal is set in a range of from 0 degrees to 60 degrees.

7. The condenser according to claim 3, wherein an angle between each of the first and second plate bodies and the horizontal is set in a range of from 0 degrees to 60 degrees.

8. The condenser according to claim 4, wherein an angle between each of the first and second plate bodies and the horizontal is set in a range of from 0 degrees to 60 degrees.

9. The condenser according to claim 1, wherein an angle between each of the first and second plate bodies and the horizontal is set in a range of from 3 degrees to 10 degrees.

10. The condenser according to claim 2, wherein an angle between each of the first and second plate bodies and the horizontal is set in a range of from 3 degrees to 10 degrees.

11. The condenser according to claim 3, wherein an angle between each of the first and second plate bodies and the horizontal is set in a range of from 3 degrees to 10 degrees.

12. The condenser according to claim 4, wherein an angle between each of the first and second plate bodies and the horizontal is set in a range of from 3 degrees to 10 degrees.

13. A freezer comprising:

a condenser for condensing and liquefying a refrigerant to produce liquified refrigerant, the condenser including:

a receptacle into which the refrigerant is induced;

thermal transmission pipes for carrying cooling water through the receptacle of the condenser, the thermal transmission pipes being arranged in at least first, second, and third bundles in the receptacle; and at least first and second plate bodies with the first plate body being located between the first and second bundles of the thermal transmission pipes, and the second plate body being located between the second and third bundles of the thermal transmission pipes, each of the first and second plate bodies sloping diagonally downwardly when viewed in cross-section from a direction of the length of the thermal transmission pipes;

an expansion value which decompresses the liquified refrigerant to produce a decompressed refrigerant;

an evaporator which evaporates and vaporizes the decompressed refrigerant to produce a vaporized refrigerant; and a compressor which compresses the vaporized refrigerant and supplies the vaporized refrigerant to the condenser.

* * * * *